United States Patent [19]

Thorsell et al.

[11] Patent Number: 4,648,985

[45] Date of Patent: Mar. 10, 1987

[54] EXTREME PRESSURE ADDITIVES FOR LUBRICANTS

[75] Inventors: Paul W. Thorsell, Rockwall; Mark A. Mulvihill, Garland, both of Tex.

[73] Assignee: The Whitmore Manufacturing Company, Rockwall, Tex.

[21] Appl. No.: 882,040

[22] Filed: Jul. 7, 1986

Related U.S. Application Data

[63] Continuation of Ser. No. 671,760, Nov. 15, 1984.

[51] Int. Cl.[4] ..... C10M 157/04; C10M 157/10

[52] U.S. Cl. ..... 252/32.5; 252/32.7 E; 252/35; 252/47.5

[58] Field of Search ..... 252/32.5, 32.7 E, 33.6, 252/46.4, 47.5, 35

[56] References Cited

U.S. PATENT DOCUMENTS

| | | | |
|---|---|---|---|
| 2,201,258 | 5/1940 | Busse | 252/47.5 |
| 4,259,192 | 3/1981 | Lilburn | 252/32.7 E |
| 4,466,895 | 8/1984 | Schroeck | 252/327 E |
| 4,501,678 | 2/1985 | Katayama et al. | 252/47.5 |

OTHER PUBLICATIONS

Smalheer et al; "Lubricant Additives", vol. I, 1967, pp. 10–11.

*Primary Examiner*—Jacqueline V. Howard

*Attorney, Agent, or Firm*—Pearne, Gordon, McCoy & Granger

[57] ABSTRACT

Lubricant additives are provided which provide extreme pressure properties without the need for lead compositions. The extreme pressure additive system includes a dithio carbamate substituent, an organic copper substituent; and an phosphate substituent which are provided in a three component or two component system.

21 Claims, No Drawings

EXTREME PRESSURE ADDITIVES FOR LUBRICANTS

This is a continuation of application Ser. No. 671,760, filed on Nov. 15, 1984.

BACKGROUND OF THE INVENTION

Additives are used with lubricants in order to reduce friction and increase the load carrying capacity of the lubricants. When employed in lubricants for use under extreme pressure conditions, these additives have become known as "EP" (extreme pressure additives). These lubricants are used, for example, with the type of heavy equipment used for drilling. mining, and earth moving operations and other heavy industrial applications, for example, for open and enclosed gear lubricants, house roller and rail lubricants, and for walking cam lubricants and bearing lubricants. In such cases, the base lubricants may be squeezed from between the bearing surfaces, leaving the additives to do the lubricating. These additives prevent the welding of two contacting surfaces following galling or cleavage and the production of wear fragments.

In the past, it was found that certain heavy metal soaps alone, and in combination with sulphur compounds, provided a means by which lubricating oils and greases could be made to withstand high unit loading, and to reduce wear and friction. These heavy metals primarily comprise lead, antimony, arsenic, and bismuth.

More recently, however, the use of these metal soaps has been criticized for their effect on the environment and the toxicity of these metals. Laws and regulations have been promulgated to limit the use of such metals. It has therefore become desirable, if not mandatory, to form EP additives without the use of these heavy metals, principally lead.

Recently, technology has been developed to provide the desired extreme pressure characteristics without the use of such metal soaps. For example, U.S. Pat. No. 4,259,192 discloses extreme pressure additives utilizing dithiophosphate esters of a diphosphoric acid and poly(oxalkylene)alcohol, as well as the salts of these compounds. The dithiophosphates have molecular weights ranging from 500 to 500,000, and the salts of the dithiophosphates are, for example, alkali, alkaline earth, heavy metal, and ammonium salts. However, it has been believed that under specific conditions, such as high loads and slow speeds, only lead or antimony additives can provide the desired protection.

This invention discloses new compositions to produce the protection provided by lead and antimony compounds without employing the use of such compounds. In particular, this invention provides the desired EP properties, and in addition stability in storage, while eliminating the use of environmentally dangerous and toxic heavy metals. These compositions are useful at slow speeds, such as at sliding velocities of less than 400 feet per minute, and at high loads, such as 130,000 psi, on cams, and at 50,000 to 60,000 psi at the point of contact for gears. They can also be useful at high speeds as well.

It has been thought in the past that the heavy metal compounds, such as the lead-containing materials, are effective in reducing wear and scoring by plating a minute layer of lead metal on the surfaces of the parts to be lubricated. When these parts are subjected to extreme loads greater than the base lubricants can withstand, the lead metal becomes the lubricant. Since the lead metal is soft and ductile, it forms a film between the two moving surfaces.

While it has been known in the past that copper additionally will plate out, forming the phenomenon known as "copper plating," this has only been considered to be a disadvantage. For example, U.S. Pat. No. 4,355,960 discusses the phenomenon of copper plating with regard to compressor refrigeration systems. In this case, the chlorofluorocarbon refrigerant and lubricating oils form corrosive products which dissolve copper from the refrigerating mechanism. The copper becomes redeposited onto parts of the compressor or within the fluorocarbon refrigeration systems, causing blockage of the refrigerant.

It has not been known in the past, however, to utilize this phenomenon for its lubricating abilities in extreme pressure situations.

We have found that by using proper chemical combinations, the materials subjected to the extreme pressure and temperature of heavily loaded machines will form a thin copper or molybdenum layer on the moving surfaces, which acts similarly to materials of the more toxic heavy metals, such as lead, but which does not present the same hazards. This plating presents excellent extreme pressure lubricative properties, especially under slow speeds and high loads. Under certain conditions, it is even possible to see the copper plate at the pressure point.

SUMMARY OF THE INVENTION

Two embodiments of the invention are presented. In the first embodiment, a three-component system is provided. This system is added to the base lubricant to provide extreme pressure properties. The three-component system consists of:

(1) A dithiocarbamate being characterized by the following formula:

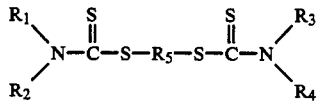

where $R_1$–$R_4$ may be the same or different and are hydrogen or hydrocarbon having from 1 to 22 carbon atoms. $R_5$ is a hydrocarbon of between 1 and 8 carbon atoms;

(2) An organic copper or molybdenum compound having one of three following formulae:

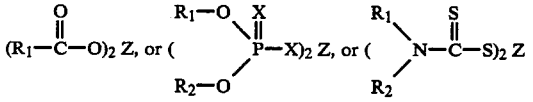

where Z is copper or molybdenum, X is oxygen or sulfur and $R_1$, $R_2$ can be the same or different, and can be hydrogen or hydrocarbon having from 1 to 22 carbon atoms, and (3) An organic phosphate compound of the formula:

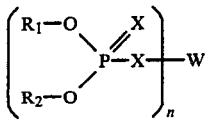

where X is sulfur or oxygen; n is 1–4; $R_1$, $R_2$ can be the same or different, and can be hydrogen or hydrocarbon having from 1 to 22 carbon atoms, and W is hydrocarbon or amine having from 1 to 22 carbon atoms, or a metal selected from the group consisting of heavy and light metals, alkali and alkaline earth metals.

In a second embodiment, a two-component additive package is provided. Two of the important functional groups of the components in the three-component system are combined in a single compound. Thus, the two-component system still has a dithiocarbamate functional group, a phosphate functional group, and a copper or molybdenum compound.

Two variations of the two-component additive package exist. The first system comprises:

(1) a copper or molybdenum dithio carbamate of the formula:

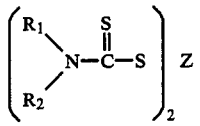

where Z is copper or molybdenum, $R_1$ and $R_2$ can be the same or different, and can be hydrogen or a hydrocarbon having between 1 and 22 carbon atoms; and (2) a phosphate of the formula:

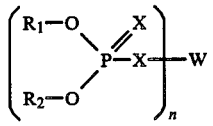

where X is oxygen or sulfur, n is 1–4, and $R_1$ and $R_2$ can be the same or different, and are hydrogen or a hydrocarbon having between 1 and 22 carbon atoms; and W is hydrogen, hydrocarbon, or amine having between 1 and 22 carbon atoms, or a metal selected from the group consisting of the heavy and light metals.

The second system comprises:

(1) a metal organophosphate of the formula:

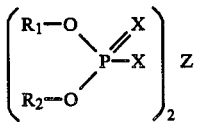

where Z is copper or molybdenum, X is oxygen or sulfur, and $R_1$ and $R_2$ are the same or different, and are hydrogen or hydrocarbon having between 1 and 22 carbon atoms; and (2) a dithio carbamate characterized by one of the following formulae:

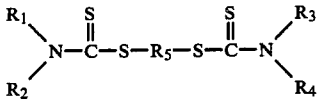

where $R_1$–$R_4$ are the same or different, and are hydrogen or hydrocarbon having between 1 and 22 carbon atoms. $R_5$ is a hydrocarbon of between 1 and 8 carbon atoms, or

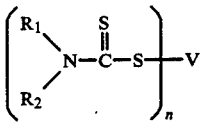

where n is 1–4; $R_1$ and $R_2$ are the same or different and are chosen from the group of hydrogen and hydrocarbon having 1 to 22 carbon atoms and V is an amine or a metal selected from the group consisting of the heavy and light metals, alkali metals and alkaline earth metals.

DESCRIPTION OF THE PREFERRED EMBODIMENTS

The invention concerns lubricants comprising a base and an EP additive system which impart extreme pressure properties, because of the plating phenomena, to the lubricants. Two embodiments are presented. A first embodiment consists of a three-component extreme pressure additive system comprising (1) a dithio carbamate characterized by the following formula:

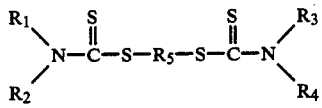

where $R_1$ to $R_4$ are the same or different and are hydrogen or hydrocarbon having from 1 to 22 carbon atoms, preferably being an aliphatic or aromatic having between 4 and 18 carbon atoms and more preferably being a branched alkyl or aryl from 4 to 12 carbon atoms. $R_5$ is a hydrocarbon of between 1 and 8 carbon atoms, and more preferably an aliphatic between 1 and 5 carbon atoms, and most preferably an alkyl having 1 or 2 carbon atoms.

An example of a preferred carbamate is methylene bis(dibutyl dithio carbamate). This compound is commercially available under the name "Vanlube" 7723" from the R. T. Vanderbilt Company of Norwalk, Conn.

In addition, a dithio carbamate having a single functional group may be used. The carbamate would have the following formula:

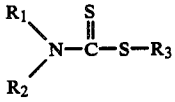

where $R_1$–$R_3$ are defined as above, and, in addition, $R_3$ may be an amine having from 1 to 22 carbon atoms or a metal.

(2) A metal compound having one of three following formulae:

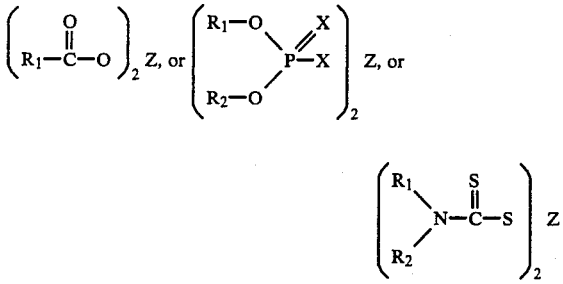

where Z is copper or molybdenum, X is oxygen or sulfur and $R_1$ and $R_2$ are the same or different and are hydrogen or a hydrocarbon having from 1 to 22 carbon atoms and preferably an aliphatic or aromatic having between 4 and 18 carbon atoms, and most preferably a branched aliphatic or carbon-substituted aromatic having between 5 and 12 carbon atoms. As for the carbamates, the side chains help to make this compound soluble in the base lubricants. Longer, branched chains are more soluble than short, straight chains; however, the shorter the side chain, the higher the relative concentration of the functional group in relation to the total molecular weight of the compound. A lower total molecular weight is preferable, since less additive needs to be added to provide the same amount of active ingredient as for a compound having a higher molecular weight.

The most preferred compounds have a carbon chain length sufficient to make these compounds soluble, such as, for example, isooctanol, octyl phenol, or tertiarybutyl creosol. It is also believed that an aromatic side chain stabilizes the phosphates, so that a carbon-substituted aromatic is preferable.

Insoluble salts may also be used in lubricating greases. The effect of using insoluble salts is a decrease in the storage stability.

The metallo-organic compounds can be, for example, copper carboxylate made from straight or branched-chain organic acids, or aromatic or cyclic organic acids. Copper octoate is an example of such a compound. It is available commercially under the name of "12% Copper Cem-All" from Mooney Chemicals, Inc. in Cleveland, Ohio.

Copper organophosphate can be synthesized by well-known reaction mechanisms. For example, an alkyl alcohol can be reacted with phosphorous pentasulfide, and subsequently reacted with copper flake in the presence of an organic solvent.

Copper carbamates are commercially available, such as copper dimethyl dithiocarbamate sold under the name "Cumate" by the R. T. Vanderbilt Company.

(3) A phosphate compound of the formula:

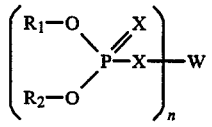

where X is sulfur or oxygen; n is 1–4; $R_1$ and $R_2$ are the same or different, and are hydrogen or a hydrocarbon having from 1 to 22 carbon atoms, and preferably an aliphatic or aromatic having between 4 and 18 carbon atoms, and most preferably a branched aliphatic or carbon-substituted aromatic between 7 and 12 carbon atoms; and W is hydrogen, hydrocarbon or amine having from 1 to 22 carbon atoms, preferably aliphatic, aromatic, or amine between 4 and 18 carbon atoms, and most preferably between 5 and 12 carbon atoms or a metal selected from the group consisting of the heavy and light metals, alkali and alkaline earth metals, and preferably consisting of copper, zinc, antimony, molybdenum, and lead, and most preferably consisting of copper, zinc, and molybdenum. An example of a commercially available phosphate is alkylamine phosphate sold by the R. T. Vanderbilt Company under the name "Vanlube 692."

The phosphate compounds can be chosen from a group of amines or metal-neutralized organophosphates, or amine or metal-neutralized organophosphorodithioates, such as zinc dithiophosphate. The organic portion may be aliphatic or aromatic in nature. The preferred compounds for lubricating oils have sufficient chain length to impart oil stability to the compounds from $C_5$ to $C_{22}$. However, in lubricating greases, compounds which are not oil-soluble can be used with excellent results.

The R substituents of the compounds given above help to determine the solubility in the base lubricants. Generally, the branched isomers will be more soluble than the straight chains.

In addition, a metal dithiocarbamate having the formula:

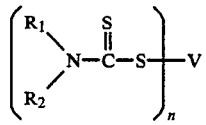

where n is 1–4, Y is molybdenum or zinc, $R_1$ and $R_2$ are hydrogen or hydrocarbon having 1 to 22 carbon atoms, may be added and V is a hydrocarbon or amine having from 1 to 22 carbon atoms or a metal selected from the group consisting of heavy and light metals, alkali or alkaline earth; more preferably consisting of zinc, copper, antimony, lead, molybdenum, and sodium; and most preferably consisting of zinc, copper and molybdenum.

In a second embodiment, a two-component additive package is provided. Two of the important functional groups of the components in the three-component system are combined in a single compound. Thus, the two-component system still has a dithiocarbamate functional group, a phosphate functional group, and a copper compound.

Two additional extreme pressure additive systems having two components are provided. The first system comprises:

(1) a copper dithio carbamate of the formula:

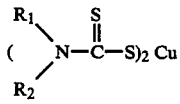

where $R_1$ and $R_2$ can be the same or different and can be hydrogen or a hydrocarbon having between 1 and 22 carbon atoms, more preferably an aliphatic or aromatic having between 4 and 18 carbon atoms, and most preferably a branched aliphatic or aromatic having between 4 and 12 carbon atoms. An example of such a compound is "Cumate" sold by the R. T. Vanderbilt Company.

(2) a phosphate of the formula:

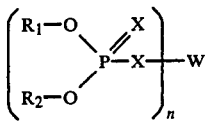

where X is oxygen or sulfur, n is 1–4, and $R_1$ and $R_2$ can be the same or different and are hydrogen, or a hydrocarbon having between 1 and 22 carbon atoms, and more preferably an aliphatic or aromatic having between 4 and 18 carbon atoms, and most preferably a branched alkyl or alkyl-substituted aromatic having between 5 and 12 carbon atoms; and W is hydrogen, hydrocarbon, or amine having between 1 and 22 carbon atoms, and more preferably alkyl aryl or amine having between 4 and 18 carbon atoms, and most preferably alkyl aryl or amine having between 4 and 12 carbon atoms or a metal selected from the group consisting of heavy and light metals, alkali and alkaline earth; and more preferably consisting of copper, zinc, antimony, molybdenum, and lead and most preferably consisting of copper, zinc, and molybdenum. An example of such a compound is "Vanlube 692" sold by the R. T. Vanderbilt Company.

The second system comprises:

(1) a metal organophosphate of the formula:

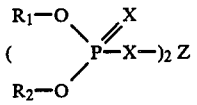

where Z is copper or molybdenum, X is oxygen or sulfur, and $R_1$ and $R_2$ are the same or different, and are hydrogen or a hydrocarbon having between 1 and 22 carbon atoms, and more preferably an aliphatic or aromatic having between 4 and 18 carbon atoms, and most preferably an alkyl or aryl aromatic having between 5 and 12 carbon atoms. This compound can be synthesized by known reaction mechanisms such as the mechanism mentioned earlier.

(2) a dithio carbamate characterized by the following formula:

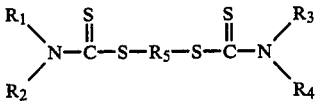

where $R_1$–$R_4$ are the same or different and are hydrogen or a hydrocarbon having between 1 and 22 carbon atoms, and more preferably an aliphatic or aromatic having between 4 and 18 carbon atoms, and most preferably a branched alkyl or aromatic having between 4 and 12 carbon atoms, $R_5$ is a hydrocarbon of between 1 and 8 carbon atoms and more preferably an aliphatic between 1 and 5 carbon atoms, and most preferably an alkyl having 1 or 2 carbon atoms. An example of such a carbamate is methylene bis(dibutyl dithio carbamate) sold under the name "Vanlube 7723" by the R. T. Vanderbilt Company.

In addition, a dithio carbamate having a single functional group may be used instead of or in addition to the bis compound. The carbamate would have the following formula:

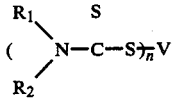

where $R_1$–$R_2$ are defined as above, n is 1–4, and V is a hydrocarbon or amine having 1 to 22 carbon atoms, or a metal selected from the group consisting of heavy and light metals, alkali and alkaline earth metals, and preferably consisting of zinc, copper, antimony, lead, molybdenum, and sodium; and most preferably consisting of zinc, copper, and molybdenum.

In the two-component system, as with the three-component system, the R substituents determine the solubility in the base lubricants. The branched and aromatic substituents provide greater solubility than the straight substituents.

These additives are to be used with a base which is a petrochemical such as a lubricating oil, asphalt, or a grease. The weight or viscosity of the base will vary according to the use and intended application. For example, for large machines and with a lubricating oil base, the grade may be as high as SAE 250 or higher; very light enclosed gear oils of refined mineral oil, for example, may be SAE 75 grade or lighter.

Suitable lubricating oils which can be used to prepare a lubricating oil composition or concentrate of this invention are oils of lubricating viscosity derived from petroleum or synthetic sources. The oils can be paraffinic, naphthenic, synthetic esters, polyethers, alkylbenzenes, or combinations thereof. Oils of lubricating viscosity have viscosities in the range of 35 to 50,000 SUS (Saybolt Universal Seconds) at 100° F. and more usually from about 50 to 10,000 SUS at 100° F. These values may even be as high as 250,000 at 210° F.

The additive may be used with an asphalt cutback, a term known in the art to mean asphalt flux or still bottom, which is cut to a lower viscosity with petroleum aromatic, or aliphatic or chlorinated solvent or mixtures thereof. Asphalt is a mixture of paraffinic, aromatic, and heterocyclic hydrocarbons. The viscosity of asphalt ranges from 2,000 SUS to semisolid at 210° F. Another method of classifying asphalt other than according to the viscosity is by the hardness or plasticity using a penetration test. The standard conditions are understood to be used if they are not specified and are 100 g. of load, 5 secs. of test time, 25° C. and the units of penetration are hundreths of a centimeter. These grades may be combined. Further, depending on the grade, the asphalt cutbacks may vary greatly according to the use. Grease is an oil which contains additives or thickeners as are known in the art, such as clay, organometallo soap, sodium stearate, or other heavy organic compounds.

The amount of additive incorporated in the base lubricant will vary according to the particular components, the base lubricant, and the use. The percentage by weight of the EP additives ranges from 0.5% to 20% for open gear lubricants and from 0.5% to 10.0% for enclosed gear lubricants.

The preferred ratios of the compounds to the lubricant base by weight are shown in the following tables:

TABLE I

| Open Gear Lubricant | |
|---|---|
| Percentage (by weight) | Compound |
| 1.7–6.3 | a. Carbamate |
| 2.0–15.0 | b. Zinc dithiophosphate |
| 1.7–6.3 | c. Copper octoate |
| 0.5–2.0 | d. Zinc carbamate |

An important measurement is the percentage of copper so that a higher percentage should be used for a higher molecular weight organic derivative. There should be 0.5% copper in the open gear lubricant.

The following ranges can be used for enclosed gear lubricants. These lubricants work at lower loads, higher speeds, and with a continuous oil bath.

TABLE II

| Enclosed Gear Lubricant | |
|---|---|
| Percentage (by weight) | Compound |
| 1.0–5.0 | a. Carbamate |
| 1.0–9.0 | b. Zinc dithiophosphate |
| 1.0–5.0 | c. Copper octoate |

These ratios were determined by holding each compound constant and varying the proportion of the other contents to arrive at the optimal ratios. The testing was performed using Timken EP tester, and 4-ball EP tester to ASTM standards with some modification, for example by varying the standard test speeds.

In addition, conventional additives as are known in the art may be added to the lubricant. Such additives include dispersants (such as sulphonates and phenates), oxidation inhibitors (such as hindered phenols and high molecular weight amines), antifoam agents (such as silicone esters), viscosity index improvers (such as acrylate compounds and polyolefins), pour-point depressants (such as acrylate compounds, chlorinated wax), and sulphurized materials (such as dibenzyldisulfide, sulfurized sperm oil, and the like).

The following examples aare presented to illustrate specific embodiments of the practice of this invention, and should not be interpreted as limitations on the scope of the invention. The testing was performed using Timken EP tester, and 4 ball EP tester to ASTM standards.

EXAMPLE 1

A blend was made of 76.0% 100 penetration asphalt; 14.0% solvent; 5.0% copper dimethyl dithio carbamate, Cumate; and 5.0% alkyl amine dithio phosphate, Vanlube 692. The asphalt is melted at 200° F. and solvent is added with mixing. The additives are mixed into the asphalt cutback at approximately 180° F. The resulting mixture gave a 4-ball weld point of 620 kilograms. Individually, the additives each gave 4-ball weld points of 400 kilograms.

EXAMPLE 2

A blend was made of 76.0% 100 penetration asphalt, 14.0% solvent; 5.0% copper diamyl dithiocarbamate from R. T. Vanderbilt Company, and 5.0% alkyl amine dithio phosphate, Vanlube 692. The 4-ball weld point was 800 kilograms. The copper compound alone gave a 4-ball weld point of 400 kilograms at concentrations of 5% and 10%.

EXAMPLE 3

A blend was made using an asphalt cutback similar to that of Example 1, using 72.7% 100 penetration asphalt and 13.4% solvent, with the following additives: 6.0% copper octoate, 12.0% copper Cem-All, 4.9% methylene bis(dibutyl dithio carbamate), Vanlube 7723; and 3.1% alkyl amino dialkyl phosphate, Vanlube 692. This combination gave the following results: a 4-ball weld point of 620 kilograms, a 4-ball load wear index of 126 kilograms, a 4-ball wear of 0.68 millimeters, and a Timken OK load of 60 lbs.

EXAMPLE 4

A blend was made using an asphalt cutback similar to that of Example 1, using 67.2% 100 penetration asphalt and 12.4% solvent with the following additives: 5.2% copper octoate, 12.0% Copper Cem-All, 12.4% sulphurized fatty material, sulphurized methyloleate or sulphurized Lardall lard oil OA-300 and OA-270 from Pearsall, Mayco 1351 from Mayco. Oil and Chemical Company, Inc.; and 2.8% alkyl amine dialkyl phosphate, Vanlube 692. This combination gave a 4-ball weld point of 315 kilograms. This indicates the need for the dithio carbamate structure to provide the high extreme pressure results.

EXAMPLE 5

A blend was made using an asphalt cutback similar to that of Example 1, using 76.0% 100 penetration asphalt and 14.0% solvent with the following additives: 5.0% copper octoate, 12.0% Copper Cem-All, and 5.0% alkyl amine dialkyl phosphate, Vanlube 692. The combination gave a 4-ball weld point of 400 kilograms. This also indicates the need for the dithio carbamate structure to provide high extreme pressure results.

EXAMPLE 6

A blend was made using an asphalt cutback similar to that of Example 1, using 77.2% 100 penetration asphalt and 14.2% solvent with the following additives: 3.4% alkyl amino dialkyl phosphate, Vanlube 692; and 5.2% methylene bis(dibutyl dithio carbamate), Vanlube 7723. This combination gave a 4-ball weld point of 400 kilograms. This indicates that the combination requires the presence of copper to provide the high extreme pressure results.

EXAMPLE 7

A blend was made using an asphalt cutback similar to that of Example 1, using 71.7% 100 penetration asphalt and 13.2% solvent with the following additives: 12.1% zinc diamyl dithio carbamate, Vanlube AZ; and 3.0% alkyl amine dialkyl phosphate, Vanlube 692. This combination gave a 4-ball weld point of 315 kilograms. This indicates that zinc cannot be used to replace copper in this composition.

EXAMPLE 8

A blend was made using an asphalt cutback similar to that of Example 1, using 74.1% 100 penetration asphalt and 13.7% solvent with the following additives: 3.9% copper octoate, 12.0% Copper Cem-All, 3.9% methylene bis(dibutyl dithio carbamate), Vanlube 7723, and 4.4% zinc dialkyl phosphoro dithioate, OLOA 267 from Chevron. This combination gave a 4-ball weld of 620 kilograms. This indicates that the phosphorous material can be either dithio or a phosphate composition.

EXAMPLE 9

A blend was made using an asphalt cutback similar to that of Example 1, using 70.7% 100 penetration asphalt and 13.0% solvent with the following additives: 3.7% copper octoate, 12.0% Copper Cem-All, 3.7% methylene bis(dibutyl dithio carbamate), Vanlube 7723, and 8.8% zinc diarene phosphoro dithioate, OLOA 260. This combination gave the following result: 4-ball weld point of 620 kilograms, 4-ball load wear index of 108 kilograms, 4-ball wear of 0.47 millimeters. This indicates that arene phosphates can be substituted for alkyl.

EXAMPLE 10

A blend was made using petroleum base oils having a viscosity at 210° F. of 240 SUS with the following additives: 2.5% copper octoate, 12.0% Copper Cem-All, 2.5% methylene bis(dibutyl dithio carbamate), Vanlube 7723; and 5.9% zinc diarene phosphoro dithioate. This lubricant formula gave the following results: 4-ball weld point of 500 kilograms, 4-ball load wear index of 69 kilograms, 4-ball wear of 0.53 millimeters.

EXAMPLE 11

An NLGI 1 grade lubricating grease was made from mineral oil having a viscosity of 750 SUS at 210° F. and an inorganic clay thickener. The following additives were added: 4.0% copper octoate, 12.0% Copper Cem-All, 4.0% methylene bis(dibutyl dithio carbamate), Vanlube 7723; and 9.5% zinc diarene phosphoro dithioate, OLOA 260. This grease formula gave the following results: 4-ball weld point of 620 kilograms, 4-ball load wear index of 110 kilograms, 4-ball wear of 0.96 millimeters.

EXAMPLE 12

An NLGI 1 grade lubricating grease was made from mineral oil having a viscosity of 750 SuS at 210° F. and an inorganic clay thickener. The following additives were added: 2.5% copper dimethyl dithiocarbamate, Cumate; and 3.65% alkyl amine dialkyl phosphate, Vanlube 692. This grease formula gave the following results: 4-ball weld of 500 kilograms, 4-ball wear of 0.90 millimeters.

These additives can be used in various gear systems, e.g., enclosed and open gear lubricants. The additives may be used with a solvent which is run only once through the gear in an open gear system. In addition, it is envisioned that the lubricants may be used for bearing greases, cam lubricants, and drying compounds for the metal industry.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. An extreme pressure lubricant comprising a base and an extreme pressure additive system comprising:

(a) an organic copper compound of the formula I

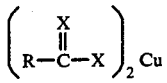

I where X is sulphur or oxygen, if X is sulphur, R is an amine; if X is oxygen, R is hydrogen or hydrocarbon having 1 to 22 carbon atoms;

(b) a dithio carbamate of the formula II

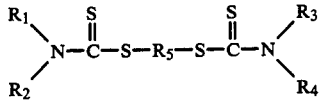

II where $R_1$–$R_4$ can be the same or different, and are selected from the group of hydrogen and hydrocarbon of 1 to 22 carbon atoms and $R_5$ is a hydrocarbon having 1 to 8 carbon atoms; and (c) an organic phosphate of the formula III

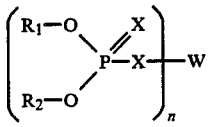

III where X is sulphur or oxygen, n is 1–4, $R_1$ and $R_2$ are the same or different, and are selected from the group of hydrogen and hydrocarbon of 1 to 22 carbon atoms, and W is hydrogen, hydrocarbon, or amine of 1 to 22 carbon atoms, or a metal selected from the group consisting of the heavy metals, the light metals, the alkali metals and the alkaline earth metals; and whereby copper is provided by the extreme pressure additive system in a sufficient quantity and form to be accessible for copper plating under extreme pressure conditions and the extreme pressure additive system is sufficiently stable for usage and storage.

2. An extreme pressure lubricant as set forth in claim 1, where in the copper compound having the formula I, X is oxygen and R is aliphatic or aromatic having between 4–18 carbon atoms; in the dithio carbamate having the formula II, $R_1$ to $R_4$ are aliphatic or aromatic having 4–18 carbon atoms; and in the phosphate having the formula III, $R_1$ and $R_2$ are the same or different and are an aliphatic or aromatic, and W is an aliphatic, aromatic or amine having between 4–18 carbon atoms or a metal selected from the group consisting of copper, zinc and molybdenum.

3. An extreme pressure lubricant as set forth in claim 1, where in the copper compound having the formula I, X is oxygen and R is branched aliphatic or alkyl substituted aromatic having between 5–12 carbon atoms; the dithio carbamate having the formula II, $R_1$ to $R_4$ are the same or different and are branched alkyl or aryl having 4–12 carbon atoms; and in the phospate having the formula III, $R_1$ and $R_2$ are the same or different and are a branched aliphatic or alkyl-substituted aromatic, and W is an aliphatic, aromatic or amine having between 5–12 carbon atoms or a metal selected from the group consisting of copper, zinc and molybdenum.

4. An extreme pressure lubricant as set forth in claim 1, wherein the extreme pressure additive system has the following proportions by weight:

15%–25% (a) and
20%–35% (b)
30%–70% (c).

5. An extreme pressure lubricant as set forth in claim 1, wherein the extreme pressure additive system is present in the lubricant at from about 0.5% to about 20.0% by weight.

6. An extreme pressure lubricant as set forth in claim 1, including in addition one or more of the following additives: dispersants, oxidation inhibitors, pour-point depressants, antifoam agents, and viscosity index improvers.

7. An extreme pressure lubricant as set forth in claim 1, wherein said base is selected from the group consisting of petroleum-derived oil, asphalt, and grease.

8. An extreme pressure lubricant comprising a base and an extreme pressure additive system comprising:

(a) a copper carbamate compound of the formula I

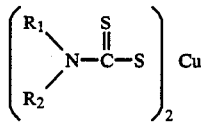

I where $R_1$ and $R_2$ are the same or different and are selected from the group of hydrogen and hydrocarbon having from 1 to 22 carbon atoms; and (b) a phosphate of the formula II

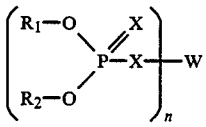

II where X is sulphur or oxygen, n is 1–4, $R_1$ and $R_2$ are the same or different, and are selected from the group of hydrogen and hydrocarbon of 1 to 22 carbon atoms, and W is hydrogen, hydrocarbon, or amine of 1 to 22 carbon atoms, or a metal selected from the group consisting of the heavy metals, the light metals, the alkali metals and the alkaline earth metals; and whereby copper is provided by the extreme pressure additive system in a sufficient quantity and form to be accessible for copper plating under extreme pressure conditions and the extreme pressure additive system is sufficiently stable for usage and storage.

9. An extreme pressure lubricant as set forth in claim 8, where in the copper carbamate of the formula I, $R_1$ and $R_2$ are the same or different and are aliphatic or aromatic having 4–18 carbon atoms; and in the phosphate of the formula II, $R_1$ and $R_2$ are the same or different and are aliphatic or aromatic having 4–18 carbon atoms; and W is hydrocarbon or amine having 1 to 22 carbon atoms or a metal selected from the group consisting of copper, zinc and molybdenum.

10. An extreme pressure lubricant as set forth in claim 8, where in the copper carbamate of the formula I, $R_1$ and $R_2$ are the same or different and are branched aliphatic or aromatic having 4–12 carbon atoms; and in the phosphate of the formula II, $R_1$ and $R_2$ are the same or different and are branched alkyl or alkyl-substituted aromatic having 4–12 carbon atoms; and W is amine having 1 to 22 carbon atoms or a metal selected from the group consisting of copper, zinc, and molybdenum.

11. An extreme pressure lubricant as set forth in claim 8, wherein the extreme pressure additive system is present in the lubricant at from about 0.5% to about 20.0% by weight.

12. An extreme pressure lubricant as set forth in claim 8, including in addition one or more of the following additives: dispersants, oxidation inhibitors and pour-point depressants, antifoam agents, and viscosity index improvers.

13. An extreme pressure lubricant as set forth in claim 8, wherein said base is selected from the group consisting of petroleum-derived oil, asphalt, and grease.

14. An extreme pressure lubricant comprising a base and an extreme pressure additive system comprising:

(a) a copper phosphate of the formula I

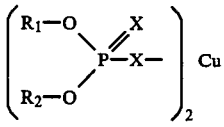

I where X=sulphur or oxygen, $R_1$ and $R_2$ are the same or different, and are selected from the group of hydrogen, alkyl or arene having from 1 to 22 carbon atoms; and (b) a dithocarbamate of the formula II

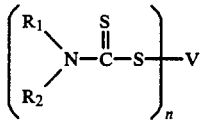

II where n is 1–4, $R_1$ and $R_2$ are the same or different and are selected from the group of hydrogen and hydrocarbon having 1 to 22 carbon atoms, and V is hydrogen, hydrocarbon or amine having 1 to 22 carbon atoms or a metal selected from the group consisting of the heavy metals, the light metals, the alkali metals or the alkaline earth metals; and whereby copper is provided by the extreme pressure additive system in a sufficient quantity and form to be accessible for copper plating under extreme pressure conditions and the extreme pressure additive system is sufficiently stable for usage and storage.

15. An extreme pressure lubricant as set forth in claim 14, where in the copper phosphate of the formula I, $R_1$ and $R_2$ are the same or different and are aliphatic or aromatic having 4–18 carbon atoms; in the dithio carbamate of formula II, $R_1$–$R_2$ are the same or different and are aliphatic or aromatic having 4–18 carbon atoms; and V is amine having 1–22 carbon atoms or a metal selected from the group consisting of copper, zinc and molybdenum.

16. An extreme pressure lubricant as set forth in claim 14, where in the copper phosphate of the formula I, $R_1$ and $R_2$ are the same or different and are alkyl or alkly-substituted aryl; in the dithio carbamate of formula II, $R_1$–$R_2$ are the same or different and are alkyl or aryl of 4–12 carbon atoms, and V is amine having 1–22 carbon atoms or a metal selected from the group consisting of copper, zinc and molybdenum.

17. An extreme pressure lubricant as set forth in claim 14, where n is 1 and V is hydrogen or an amine of the formula:

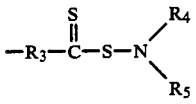

and $R_3$ is hydrocarbon having 1 to 8 carbon atoms, and $R_4$ and $R_5$ are the same or different and are aliphatic or aromatic having 1–22 carbon atoms.

18. An extreme pressure lubricant as set forth in claim 14, where V is a metal selected from the group consisting of copper, zinc or molybdenum.

19. An extreme pressure lubricant as set forth in claim 14, where the additive system comprises in addition an organic phosphate of the formula III

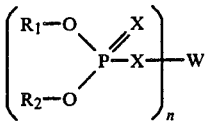

III where X is sulphur or oxygen, n is 1–4, $R_1$ and $R_2$ are the same or different and are selected from the group of hydrogen and hydrocarbon of 1 to 22 carbon atoms, and W is hydrogen, or hydrocarbon of 1 to 22 carbon atoms, or a metal selected from the group consisting of the heavy metals, the light metals, the alkali metals and the alkaline earth metals; and whereby copper is provided by the extreme pressure system in a sufficient quantity and form to be accessible for copper plating under extreme pressure conditions and the extreme pressure additive system is sufficiently stable for usage and storage.

20. An extreme pressure lubricant as set forth in claim 14, including in addition one or more of the following additives: dispersants, oxidation inhibitors and pour-point depressants, antifoam agents and viscosity index improvers.

21. An extreme pressure lubricant as set forth in claim 14, wherein said base is selected from the group consisting of petroleum-derived oil, asphalt, and grease.

* * * * *